United States Patent [19]

Kwan

[11] 4,090,475

[45] May 23, 1978

[54] SELF-CLEANING FLUID INJECTION SYSTEM

[75] Inventor: Philip H. Kwan, Pasadena, Calif.

[73] Assignee: S. E. Rykoff & Co., Los Angeles, Calif.

[21] Appl. No.: 687,700

[22] Filed: May 19, 1976

[51] Int. Cl.[2] ..... D06F 33/02

[52] U.S. Cl. ..... 222/70; 222/144.5; 222/148; 222/193

[58] Field of Search ..... 222/70, 136, 144.5, 222/129, 148, 193

[56] References Cited

U.S. PATENT DOCUMENTS

| | | | |
|---|---|---|---|
| 2,362,674 | 11/1944 | Spangler et al. | 222/136 X |
| 2,965,268 | 12/1960 | Bauerlein | 222/193 |
| 3,717,285 | 2/1973 | Hatton | 222/136 |
| 3,764,041 | 10/1973 | Noll | 222/148 X |
| 3,826,113 | 7/1974 | Norass et al. | 222/70 X |

*Primary Examiner*—Robert B. Reeves
*Assistant Examiner*—Joseph J. Rolla
*Attorney, Agent, or Firm*—Wills, Green & Mueth Law Corporation

[57] ABSTRACT

Apparatus for delivering different additive fluids in controlled amounts to equipment utilizing those fluids, such as laundry or dishwashing equipment, with the apparatus including valves for passing the different fluids to a pump unit, desirably actuated by individual timers controlled by separate product control switches, and with the apparatus acting to automatically feed flushing water past the discharge sides of the valves and through the pump after each operation of the equipment to clean the system of the additive fluids in preparation for a next successive operation.

13 Claims, 2 Drawing Figures

SELF-CLEANING FLUID INJECTION SYSTEM

BACKGROUND OF THE INVENTION

This invention relates to fluid injection apparatus for feeding a plurality of different additive fluids to equipment in which the fluids are used. For example, the present apparatus may be employed to deliver to a laundry system or dishwashing unit different liquid detergents, soaps, water softeners, bleaches, or other additive liquids or solutions.

In prior equipment of this general type, problems have been encountered because of the tendency for some of the additive fluids from a particular operation of the equipment to remain in the injection pump and related valves which control delivery of the fluids to the equipment of use, and cause clogging of the pump which decreases its effectiveness on the next successive operation. Further, the chemicals which thus remain in the injection system mix with and contaminate whatever fluids may be selected for injection in the next cycle of operation, and result in incorrect application of additives to the equipment of use, and a resultant adverse effect on the overall result attained by that equipment.

SUMMARY OF THE INVENTION

The present invention provides an improved fluid injection system which is automatically self-cleaning at the end of each cycle of operation, to prevent accumulation of the additive chemicals within the injection equipment. To achieve this purpose, flushing water is passed through the injection valves and pump at the end of each injection period, to wash all remnants of the additive fluids from those parts and thereby deliver the additives in their entirety to the equipment of use. The chemical or chemicals then injected during the next successive injection period cannot be contaminated by accumulations of the prior chemicals in the valves and pump. Thus, the apparatus may function during a series of different injection periods to inject different combinations of chemicals, or different individual chemicals, with each of the combinations or individual chemicals being delivered completely to the equipment of use at the appropriate time and without contaminating intermixture with a chemical or chemicals to be delivered during a subsequent cycle.

Structurally, the apparatus includes a number of individual injection valves controlling flow of different additive fluids respectively to the suction side of a pump or pump means which then acts to discharge the selected fluids to the laundry equipment or the like. Associated flushing equipment acts at the end of each injection cycle to pass flushing water past the discharge sides of the closed injection valves and through the pump means to clean these various elements and the interconnecting lines or passages. Preferably, the flushing water flows through the discharge sides of the valves in series relation. The flushing means for supplying this cleaning water may include a valve controlling flow of water from a pressurized commercial or other source to the injection valve and pumping apparatus.

The operation of the valves and flushing equipment is controlled by timer means, which act to first open the injection valves for proper intervals, and then deliver the flushing water to the equipment. On a particular operation of the apparatus, the valves which are to be opened, and the corresponding additives which are to be injected, may be selected by actuation of related control elements or units, desirably individual manually actuated control switches associated with the various injection valves. The timer means may include a number of different timers controlling the different valves, which timers may be inconnected by circuitry causing them to operate their respective valves sequentially through a predetermined cycle, and for predetermined controllable intervals on each actuation.

BRIEF DESCRIPTION OF THE DRAWINGS

The above and other features and objects of the invention will be better understood from the following detailed description of the typical embodiments illustrated in the accompanying drawing in which.

DETAILED DESCRIPTION OF THE TYPICAL EMBODIMENTS

Figures 1, 2:
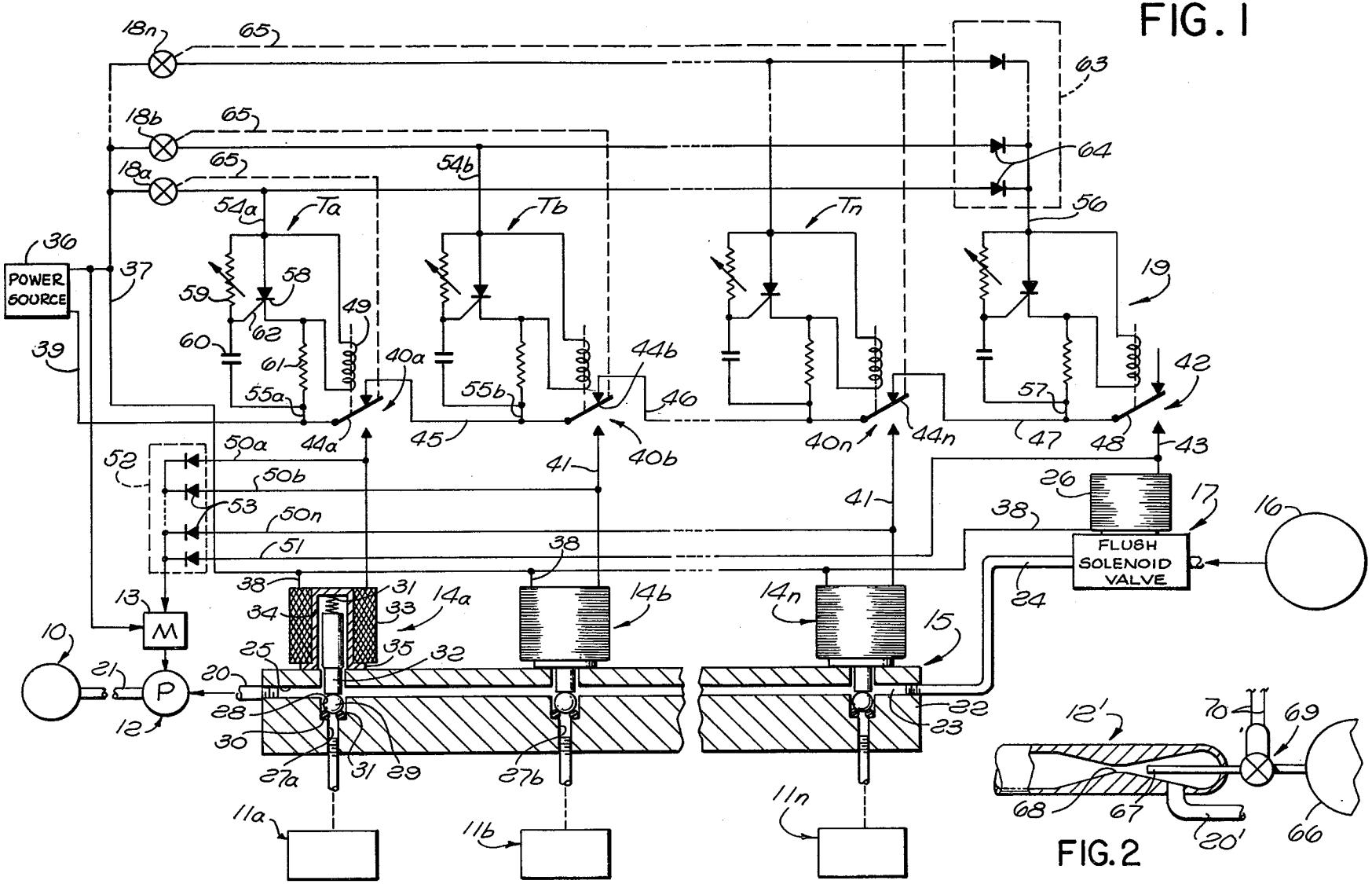
FIG. 1 is a diagrammatic representation of a fluid injection system constructed in accordance with the invention.
FIG. 2 is a fragmentary representation of a variational form of the invention.

In FIG. 1, there is represented diagrammatically at 10 a unit such as a laundry system, dishwashing machine, or other piece of equipment which performs a particular operation utilizing water, and to which there are to be supplied at predetermined times a number of fluids which are drawn from a number of different supply tanks or containers 11*a*, 11*b*, etc. to 11*n*, respectively. In a typical laundry system, there may for example be six such tanks holding six different additive liquids, all of which are either in aqueous solution form, or soluble in or compatible with water. These liquids are delivered to unit 10 by a pump 12 preferably driven by an electric motor 13, with the pump drawing the liquids through a series of solenoid valves 14*a*, 14*b*, etc. through 14*n* of a valve manifold device 15. Flushing water is supplied by a pressurized water source represented at 16, which may typically be a commercial water supply line, under the control of an additional solenoid valve 17. Individual product control electric switches 18*a*, 18*b*, etc. through 18*n* control corresponding timers $t_a$, $t_b$, etc. through $t_n$ to determine which of the various fluids are admitted to unit 10 on a particular cycle of operation of the equipment. An additional timer 19 controls valve 17 to perform a flushing operation at the end of each cycle.

The pump 12 may be any convenient type of pump which is capable of delivering the additive fluids or chemicals to unit 10 under pressure, such as for example a reciprocating piston and cylinder type pump, reciprocating diaphragm type pump, positive displacement rotary pump, or any other similar pump capable of drawing one or more of the liquids from suction line 20 and discharging it through line 21 to unit 10 so long as motor 13 is energized and in operation. There may also be utilized an aspirator type pumping system, as will be discussed at a later point in describing the variation illustrated fragmentarily in FIG. 2.

While it is contemplated that the valves 14*a*, etc. may take any of various forms, it is preferred that the manifold arrangement of FIG. 1 by employed. In that figure, the manifold device 15 includes an elongated rigid body 22 having a passage 23 extending therethrough, preferably along a straight line as shown, from an inlet end at which it receives flushing water from an inlet line 24 to an outlet end 25 connected to line 20 leading to the suction side of the pump 12. The solenoid valve 17 controls flow of pressurized flushing water from the source 16 to line 24 leading into the right end of passage 23 as viewed in FIG. 1. This valve 17 is normally closed, and is opened by energization of its coil 26.

At the location of each of the valves 14*a*, 14*b*, etc., the corresponding additive fluid can flow into passage 23 through a transverse passage 27*a*, 27*b*, 27*c*, etc. having an upper enlarged diameter portion 28 containing a ball valve 29 engageable downwardly against a seat structure which may include a transverse shoulder 30 formed at the lower end of counterbore 28, and a rubber O-ring or other seal element 31. Ball 29 is normally urged downwardly to a closed position in which seal ring 31 is clamped between and annularly engages the ball and the associated shoulder 30 to prevent flow of any of the corresponding liquid past that particular valve. A compression spring 31 exerts this downward force normally closing the ball valve element, and acts through a vertically elongated rod 32 formed of iron or another paramagnetic material which is adapted to be magnetically actuated upwardly to open the valve upon enegization of the actuating coil 33 of that particular solenoid valve. This coil 33 may be carried about a closed hollow circular element 34 whose flange 35 is sealed with respect to the upper surface of body 22, and which forms an enclosure preventing escape of any of the water of liquids from within element 34 to its exterior. It will also be appreciated that the magnetically operated part 32 may be encapsulated within an appropriate resinous plastic material, or otherwise protected against corrosion or damage by the additive liquids or water.

The solenoid coils 33 and 26 are all energized by an appropriate electrical power source represented diagrammatically at 36, a first side 37 of which is connected to the coils at 38, and the second side 39 of which is connectible through relays 40*a*, 40*b*, etc. through 40*n* with lines 41 leading to the second sides of coils 33 respectively. An additional relay 42 acts when closed to supply power to a line 43 leading to the second side of the flush control solenoid valve coil 26. With more particular reference first to relay 40*a*, the movable contact 44*a* of that relay is normally spring urged upwardly to its illustrated position in which it closes a circuit through a line 45 to the movable contact 44*b* of the second relay 40*b*. Similarly, the movable contact of that second relay 40*b* is spring urged upwardly to its illustrated position, to close a circuit through a line 46 to the movable contact of the next successive relay, and the rest of the relays through relay 40*n* are similarly connected in series. The movable contact 44*n* of relay 40*n*, in its upper normal position, closes a circuit through a line 47 to the movable contact 48 of the flush control relay 42, which is normally spring urged to its upper position.

When the coil 49 of any of the relays 40*a*, 40*b*, etc. through 40*n*, or 42, is energized, the coil then acts to swing the movable contact 44*a*, 44*b*, or the like of that particular relay downwardly to break the series relationship between the movable contacts of all of the relays, and to engage the lower contact of that particular relay closing the circuit to the corresponding line 41 or 43, and thereby open the corresponding solenoid valve 14*a*, 14*b* — or 26. Whenever any of the relays 40*a* 40*b*, etc. is in its energized condition, the engagement of the movable contact of that relay with its lower stationary contact acts also to close a circuit to a line 50*a*, 50*b* — 50*n* or 51, all of which lines are connected through an appropriate logic circuit 52 to motor 13, to energize the motor and drive pump 12 whenever any one of the relays 40*a*, 40*b*, etc. is in its downwardly actuated or energized condition. This logic circuitry is illustrated simply as an "or" circuit, including a series of diodes 53 any of which can pass current to the motor. It is noted, however, that only one of the relays can energize its associated solenoid valve at a particular time, since downward actuation of any one of the movable contacts of the relays 40*a*, etc. will break the circuit through the upper stationary contact of that relay to the movable contact of the next successive relay.

The timer circuits $t_a$, $t_b$ — $t_n$ and 19 may all be identical, and may be any conventional type of time delay circuit which when energized from power source 36 through two lines (54*a* and 55*a* for timer $t_a$, 54*b* and 55*b* for timer $t_b$, etc., and 56 and 57 for timer 19) will first energize the corresponding relay coil 49 for a predetermined timed interval, and then automatically deenergize that coil and release the movable contact of the relay at the end of that timed interval. To achieve this purpose, each timer is illustrated as including an SCR (silicon controlled rectifier) 58 connected in the illustrated arrangement with a variable resistor 59 and capacitor 60, and an additional resistor 61, with the coil 49 of the relay connected as shown. Upon initial energization of the lines 54*a* and 55*a* of timer $t_a$, for example, for SCR 58 may be nonconducting, so that current flows through coil 49 of the relay to immediately actuate its movable contact 44*a* downwardly to open the associated valve 14*a*. The energization of lines 54*a* and 55*a* gradually charges capacitor 60 through rheostat 59, to ultimately change the potential of gate 62 of the SCR to a value at which it renders the SCR conductive, to shunt across coil 49 and release movable contact 44*a* of the relay for return to its upper normal position. The time delay interval for which variable resistor 59 is set is such as to maintain valve 14*a* open for a predetermined interval just sufficient to allow delivery of the predetermined metered quantity of liquid from tank 11*a* through pump 12 to unit 10. Similarly, the corresponding variable resistors of timers $t_b$, $t_n$, etc. are set to deliver the corresponding fluids or flushing water to the pump for controlled intervals.

The upper sides of timer circuits $t_a$, $t_b$, etc. are connected to power source 36 through the individual product control switches 18*a*, 18*b*, etc. through 18*n*. These switches may typically be manually operated switches which can be actuated separately in any desired combination to select for delivery on a particular cycle of operation any desired one or group of the liquids. It is also contemplated that in some instances the switches 18*a*, 18*b*, etc. may be operated automatically by suitable control circuitry. In addition to their connection to lines 54*a*, 54*b*, etc. leading to the various timers $t_a$, $t_b$ through $t_n$, the switches 18*a*, 18*b*, etc. are also all connected to the energizing line 56 of flush control timer 19 through logic circuitry 63 typically represented as consisting of individual diodes 64 which energize the flush control timer 19 whenever any one of the switches 18*a*, 18*b*, through 18*n* is closed.

To now describe briefly a cycle of operation of the apparatus of FIG. 1, assume on an initial operation all of the various additive liquids within containers 11*a*, 11*b*, through 11*n* are to be delivered to unit 10 in sequence, and for different intervals for which the various variable resistors 59 have been preset. When all of the liquids are thus to be dispensed, the operator actuates all of the product control switches 18*a*, 18*b*, etc. through 18*n* to their closed conditions, to thereby energize the upper ends of all of the timers. Because of the described series connection between the movable contacts of the various relays 40a, 40b, etc., the first of these relays 40a will take precedence regardless of how many of the control switches is actuated, since the first timer $t_a$ will immediately be energized through its lines 54a and 55a, to immediately actuate movable contact 44a of relay 40a downwardly in a manner breaking the circuit to the movable contact of all of the other relays while at the same time closing the circuit to coil 33 of solenoid valve 14a. This actuates the element 32 of that valve upwardly, to allow ball 29 to move upwardly from its closed position, permitting flow of liquid from tank 11a through passages 27a and 28 into the horizontal passage 23, and then through line 20 to pump 12. Since the downward actuation of the movable contact of relay 40a also has closed the circuit to motor 13 of pump 12, that pump is in operation to draw the liquid from tank 11a through the discussed valve 14a, and then discharge the liquid to unit 10. This delivery of the liquid from tank 11a continues until the SCR 58 of timer $t_a$ becomes conducting, as discussed, at which time coil 49 of relay 40a is deenergized to permit return of contact 44a to its normal upper position breaking the circuit to the solenoid of valve 14a. Such return of contact 44a to its upper position energizes line 45 to the second relay $t_b$, so that it then functions in the same manner discussed in connection with relay $t_a$ to actuate relay 40b for a predetermined timed interval, to thereby open valve 14b for that interval and then close it. Return of the movable contact 44b of relay 40b to its upper position causes the next successive timer to open its associated solenoid valve for the interval for which that timer has been set. Thus, the valves 11a, 11b, etc. through 11n are all opened individually controlled timed intervals, and sequentially, to admit metered amounts of the liquids in the various tanks to pump 12 in that sequence. When the final relay 40n returns to its normal deenergized condition, this delivers power through line 47 to the flush control timer 19, which then actuates its relay 42 to closed condition, to maintain solenoid valve 17 open for a predetermined interval, until the timer 19 completes its cycle, and returns relay 42 to open condition terminating the entire series of operations. Each of the timers and/or associated relay 40a or the like, and/or the associated control switch 18a or the like, is so designed that the relay and its associated solenoid valve 14a or the like can only be actuated once during each cycle of operation of the overall system. For example, to attain this purpose the switch 18a may be of a type which, when once actuated to closed condition, will remain in that closed condition until the movable contact 44a of relay 40a has been actuated downwardly and then returned upwardly, with such upward return of movable contact 44a serving to release switch 18a for return to its open condition, thereby preventing further reactuation of timer $t_a$ and the related equipment until switch 18a is subsequently purposely closed on a next successive operation of the equipment. Similarly, switch 18b will remain in closed condition until relay contact 44b has moved downwardly and then returned upwardly, and then will automatically open, and the same is true of all of the other control switches through 18n. This interlock between switch 18a and movable contact 44a, and corresponding interlocks between the other switches and relay contacts, are represented diagrammatically by the broken lines 65 of FIG. 1. The flow of flush water through passage 23 of the manifold assembly 15 upon actuation of relay 42 at the end of each cycle of operation causes water to move past the discharge sides of each of the closed valve elements 29, to carry any remaining chemicals from the discharge sides of those valves to pump 12, so that the pump can then force the water and chemicals to unit 10. The interval for which valve 17 is maintained in open condition is long enough to assure removal of all of the liquids from these various passages, valves and the pump, so that the apparatus is completely clean in preparation for the next cycle of operation.

On each cycle, as many of the liquids as may be desired can be selected by actuation of the appropriate switches 18a, 18b, or the like, so that any one or more of the liquids can be delivered to unit 10 on a particular cycle, with the flushing effect being attained at the end of each such operation. The circuitry scans through all of the timers sequentially, as discussed, but is not effective to open the solenoid valve associated with any of the timers whose control switch 18a or the like has not been closed. This is true because that particular timer is not energized, and the circuitry will merely skip through any such unselected timers to the next successive one for which the switch 18 has been closed.

FIG. 2 shows diagrammatically and fragmentarily an arrangement in which an aspirator type pump 12' has been substituted for the pump 12 of FIG. 1. In FIG. 2, the pump is powered by pressurized water from a source represented at 66, which delivers water through the primary nozzle 67 of the aspirator or ejector 12' into the reduced dimension throat 68, to draw the metered additive liquids through a suction line 20' corresponding to line 20 of FIG. 1. The flow of water to the primary nozzle 67 of the aspirator is controlled by a solenoid valve 69 which is energized by two lines 70 corresponding to the energizing connections to motor 13 of FIG. 1. All of the rest of the circuitry and valving of FIG. 1 is duplicated in the FIG. 2 arrangement, with the water and metered fluids which are discharged from aspirator 12' being delivered to a unit of the type represented at 10 in FIG. 1.

While certain specific embodiments of the present invention have been disclosed as typical, the invention is of course not limited to these particular forms, but rather is applicable broadly to all such variations as fall within the scope of the appended claims.

I claim:

1. A fluid injection apparatus comprising:

pump means for delivering a plurality of different additive fluids to equipment utilizing said fluids;

a plurality of valves controlling flow of said different fluids respectively to the suction side of said pump means, and each including a valve element movable toward and away from a valve seat;

flushing means operable to produce a flow of flushing water to clean the valves and the pump means when the valves are closed;

timer means operable automatically through a cycle to first open at least some of said valves to pass predetermined ones of said fluids to and through the pump means, and then automatically actuate said flushing means to pass flushing water to the valves and pump means; and a manifold structure containing a common discharge passage conducting said different fluids from said plurality of valves to said pump means, and defining a common flow path through which flushing water is directed past the discharge sides of said valves sequentially;

said movable valve elements being positioned in said manifold structure and within said common flow path in a relation causing a moving stream of said flushing water in said passage to flow directly past and in washing contact with each of the valve elements to clean it.

2. Fluid injection apparatus as recited in claim 1, in which said flushing means include an additional valve connected to a source of pressurized flushing water and controlling flow of said water to all of said valve elements, and controlled by said timer means.

3. Fluid injection apparatus as recited in claim 1, in which said timer means are operable to open said valves sequentially in a predetermined timed relation.

4. Fluid injection apparatus as recited in claim 1, including control means operable to different conditions for selecting different groups of said valves to be opened by said timer means on a predetermined operation of said apparatus.

5. Fluid injection apparatus as recited in claim 1, including control means operable to different conditions for selecting different groups of said valves to be opened by said timer means on a predetermined operation of said apparatus, said timer means being constructed to open said selected valves sequentially and in a predetermined timed relation.

6. Fluid injection apparatus as recited in claim 1, including a plurality of electric control switches operable to select different ones of said valves respectively for actuation by said timer means upon a particular actuation of said apparatus, said timer means being operable to open the selected valves sequentially and in timed relation, and to then actuate said flushing means.

7. Fluid injection apparatus as recited in claim 1, in which said timer means include a plurality of timers controlling said different valves respectively, and circuitry for energizing said timers sequentially.

8. Fluid injection apparatus as recited in claim 1, in which said manifold structure includes a manifold body containing said common discharge passage and a plurality of inlet passages for said fluids respectively, and containing said valve seats and relatively movable valve elements, spring urged actuating members urging said valve elements to closed positions of engagement with said seats, and electrically energized coils isolated from said fluids for actuating said members and thereby said valve elements to open positions, said discharge passage directing said moving stream of flushing water directly past and in washing contact with said spring urged members in addition to said valve elements.

9. Fluid injection apparatus as recited in claim 8, in which said flushing means include an additional valve for controlling the flow of pressurized water from a source of such water to said discharge passage in the manifold body, and electrically energized means for actuating said additional valve.

10. Fluid injection apparatus as recited in claim 9, in which said timer means are operable to actuate said first mentioned valve elements to open condition sequentially in a predetermined timed relation, and to then electrically actuate said additional valve to open condition with said first mentioned valve elements closed.

11. A fluid injection apparatus comprising:

pump means for delivering a plurality of different additive fluids to equipment utilizing said fluids;

a plurality of valves controlling flow of said different fluids respectively to the suction side of said pump means;

flushing means operable when said valves are closed to feed water past the discharge sides of the valves to the suction side of said pump means;

timer means operable automatically through a cycle to first open at least some of said valves to pass predetermined ones of said fluids to and through the pump, and then automatically actuate said flushing means to pass flushing water past the discharge sides of said valves in closed condition and through said pump means to clean said fluids from the valves and pump means;

said valves including a manifold structure having separate inlets and separate valve seats and separate spring closed valve elements for said different additive fluids respectively, and containing passages directing said flushing water past the discharge sides of said valve seats and past said valve elements in series from said flushing means and to said pump means, there being coils for actuating said valve elements respectively from closed to open positions, and isolated from said fluids;

said flushing means including an additional valve for passing pressurized flushing water to said passages, and an additional coil for actuating said additional valve;

said timer means including a series of timers for controlling energization of said first mentioned coils respectively to open said valve elements, and an additional timer for energizing said additional coil to actuate said additional valve;

each of said timers being constructed when energized to energize the associated coil for a predetermined timed interval;

a plurality of control switches connected to said first mentioned timers respectively to select which of said timers will energize an associated one of said coils upon a particular operation of the apparatus, said switches being connected to said additional timer to condition it for actuation when any of said switches is operated;

said timer means including sequencing switches connecting said first mentioned timers and said additional timer in series to a power source in relation to scan through said timers sequentially and actuate the selected ones of said valve elements in sequence and in timed relation, followed by actuation of said additional valve to flushing condition;

each of said sequencing switches associated with said first mentioned timers having a movable contact connected to an associated one of said first mentioned timers and engageable in one position with a contact leading to a next successive timer and in the other position with a contact leading to an associated one of said coils; and circuitry for energizing said pump means so long as any of said coils is energized.

12. A fluid injection apparatus comprising:

a plurality of valves controlling flow of different fluids respectively to equipment utilizing said fluids;

flushing means operable when said valves are closed to feed water past the discharge sides of the valves to said equipment;

timer means operable automatically through a cycle to first open at least some of said valves to pass predetermined ones of said fluids to said equipment, and then automatically actuate said flushing means to pass flushing water past the discharge sides of said valves in closed condition and to said equipment to clean said fluids from the valves;

said valves including a manifold structure having separate inlets and separate valve seats and separate spring closed valve elements for said different additive fluids respectively, and containing passages directing said flushing water past the discharge sides of said valve seats and past said valve elements in series from said flushing means to said equipment, there being coils for actuating said valve elements respectively from closed to open positions, and isolated from said fluids;

said flushing means including an additional valve for passing pressurized flushing water to said passages, and an additional coil for actuating said additional valve;

said timer means including a series of timers for controlling energization of said first mentioned coils respectively to open said valve elements, and an additional timer for energizing said additional coil to actuate said additional valve, each of said timers being constructed when energized to energize the associated coil for a predetermined timed interval;

a plurality of control switches connected to said first mentioned timers respectively to select which of said timers will energize an associated one of said coils upon a particular operation of the apparatus, said switches being connected to said additional timer to condition it for actuation when any of said switches is operated;

said timer means including sequencing switches connecting said first mentioned timers and said additional timer in series to a power source in a relation to scan through said timers sequentially and actuate the selected ones of said valve elements in sequence and in timed relation, followed by actuation of said additional valve to flushing condition, each of said sequencing switches associated with said first mentioned timers having a movable contact connected to an associated one of said first mentioned timers and engageable in one position with a contact leading to a next successive timer and in the other position with a contact leading to an associated one of said coils.

13. A fluid injection apparatus comprising:

pump means for delivering a plurality of different additive fluids to equipment utilizing said fluids;

a plurality of valves controlling flow of said different fluids respectively to the suction side of said pump means, and each including a valve element movable toward and away from a valve seat;

flushing means operable to produce a flow of flushing water to clean the valves and the pump means when the valves are closed; and timer means operable automatically through a cycle to first open at least some of said valves to pass predetermined ones of said fluids to and through the pump means, and then automatically actuate said flushing means to pass flushing water to the valves and pump means;

there being passages acting to direct said flushing water to the location of each of said movable valve elements at the discharge side thereof and then from that location to said pump means in a relation causing a moving stream of the flushing water to flow directly past and in washing contact with each of said valve elements to clean it;

said timer means including a plurality of timers for actuating said different valves respectively, control switches for conditioning said different timers respectively to select which of the timers and valve elements are to be actuated on a particular operation of the apparatus, an additional timer for actuating said flushing means, and circuitry for scanning through said timers sequentially to operate the selected valves in a predetermined timed sequence and then actuate said additional timer to deliver flushing water to the valves.

* * * * *